US005775753A

United States Patent [19]

Tetelboim

[11] Patent Number: 5,775,753

[45] Date of Patent: Jul. 7, 1998

[54] EQUIPMENT FOR LOADING CONTAINERS

[75] Inventor: Boris Tetelboim, Haifa, Israel

[73] Assignee: Phoenicia America-Israel, Nazaret Ilit, Israel

[21] Appl. No.: 618,017

[22] Filed: Mar. 25, 1996

[51] Int. Cl.[6] ..... B66C 1/24

[52] U.S. Cl. ..... 294/67.21; 294/81.2; 294/81.3; 294/81.51

[58] Field of Search ..... 294/67.1, 67.2, 294/67.21, 67.22, 67.3, 67.31, 81.1, 81.2, 81.3, 81.5, 81.51, 90, 97, 122–124

[56] References Cited

U.S. PATENT DOCUMENTS

| | | | |
|---|---|---|---|
| 1,216,291 | 2/1917 | Diescher | 294/67.31 |
| 1,591,248 | 7/1926 | Tracy | 294/67.2 |
| 3,427,066 | 2/1969 | Kugler | 294/67.21 |
| 4,722,106 | 2/1988 | Scegiel et al. | 294/67.2 |

FOREIGN PATENT DOCUMENTS

| | | | |
|---|---|---|---|
| 1199-735 | 12/1985 | U.S.S.R. | 294/67.2 |

*Primary Examiner*—Dean Kramer

*Attorney, Agent, or Firm*—Frishaus, Holtz, Goodman, Langer & Chick

[57] ABSTRACT

Equipment for loading box containers with flat boxes containing a plurality of glass sheets in standing alignment. The equipment includes two parallel horizontal and spaced-apart beams connected at one end, of which the lower beam carries a box and inserts it into the container, while the upper beam features a loop attached to a crane hook and is carried across the container top. The lower beam is positioned in contact with one side of the box to be lifted and is provided with two spaced-apart grippers in the form of short bars which can be swung about pivots to either side of the beam, each serving to support a lug protruding from either end of the box. The equipment is characterized in that no portion of the lower beam protrudes beyond the top of the box, thereby permitting loading of boxes of a height almost co-extensive with the inner height of the container.

18 Claims, 9 Drawing Sheets

EQUIPMENT FOR LOADING CONTAINERS

The invention relates to equipmment for loading a box container with a plurality of boxes or packages of large height and length and of relatively small width, while utilizing the entire height and width of the container. The invention relates particularly to equipment for loading a container with plate glass packed in flat boxes of large length and height.

BACKGROUND OF THE INVENTION

Sheet glass, plate glass or other material in sheet form is generally packed in relatively flat boxes of large length and height, with each box containing a number of sheets, forming a weight of up to 2000 kg. These boxes are provided with protruding lugs at the top of their ends which serve for engagement of slings of wire or rope for lifting by crane and for transporting and loading them. For sea transport as well as for overland transport the boxes have to be packed in containers, side by side, so as to fill the entire width of the container and to utilize the allowed maximum weight. With presently available loading equipment, loading of this kind of boxes has to be made in open-top containers, owing to the height occupied by the crane arm and the slings which prevent their being loaded into a closed-top or box-container. Not only is the cost of transport in an open-top container higher then with a box container, but the contents are exposed to the inclemencies of the weather in spite of a canvas covering.

For these reasons the present invention has the object of providing equipment which permits loading of such boxes into closed-top box-containers while using mobile cranes.

It is a main object of the present invention to provide equipment that will grip the lugs protruding from each end of a box filled with plate glass or other flat sheet material, lift and load it into a container and release the lugs after lowering the box onto the floor.

It is another object to provide box-loading equipment that will not protrude above the top of the box gripped by it in order to permit loading of boxes of a height almost equal to that of the container.

It is another object to provide equipment which is readily adjustable to boixes of different lengths.

And it is another object to provide lifting and loading equipment which is itself of light weight in order not to overload the lifting crane.

Still another object is to provide equipment of relatively small height with the aim to permitting the use of low-lift cranes.

And it is a final object to provide equipment of simple design for easy handling.

SUMMARY OF THE INVENTION

The equipment according to the present invention permits the loading of a box-container with a plurality of boxes or packages of large height and length and of relatively small width, while being stacked in close standing alignment to occupy the entire width of the container. The equipment is designed for being lifted by a crane or other lifting equipment with a box attached to it and for inserting the box into the container through its open end while the crane hook remains above the container. It comprises a substantially horizontal lifting arm provided with a centrally positioned loop for the crane hook and a horizontal beam connected to the lifting arm in spaced-apart, parallel alignment by a vertical branch rigidly connecting their ends intended to remain outside the container. The beam is configured to be inserted into the container through its open end with a box attached to it by means of two spaced-apart devices (to be called "gripper members" or "grippers" in the following) adapted for gripping the two lugs protruding from the box ends while the beam itself is positioned on one side of the box without protruding beyond its top surface. The grippers are constructed in a manner allowing their being placed on either side of the beam permitting the beam to be positioned on either side of the box. The grippers can be shifted along the beam for the purpose of lifting boxes of different length, in a manner effecting the load to be supported with its center of gravity positioned vertically beneath the loop and the crane hook.

In their simplest form each gripper includes a short bar having two roughened opposed surfaces, which is pivotally mounted on the upper surface of the beam in a manner permitting their being swung about this pivot into load carrying horizontal position either to the right or to the left side of the beam. For the purpose of gripping boxes of different length the grippers are preferably mounted on sleeves which can be shifted along the beam and fastened to the beam in different standard positions. One of the grippers is provided with means for changing its standard position by a few centimeters for being adjusted to grip boxes of standard length, but of inexact dimensions.

The lifting arm may be of the same length as the beam or may be made longer for the sake of balancing the weight of the connecting branch, which may also be performed by placing a counterweight onto the side remote from the connecting branch.

For loading a box into a container the equipment is brought by a crane to one side of the box and the gripper bars are swung towards the box, after having been brought into alignment with standard box dimensions. The fixed gripper is placed below the lug at one end and the length-adjustable gripper is shifted into correct position underneath the lug at the other end of the box. Then the box is lifted and carried to the container and the box supported by the beam is inserted through its open end into the container's center portion. The equipment is then lowered until the box stands on the floor next to a previously loaded box and is further lowered to disengage the grippers from the lugs; it is then moved aside and pulled out of the container ready for loading the next box. It should be noted that placing the boxes into the central portion of the container is required in order to maintain the latter's center of gravity during loading and unloading maneuvers. It is understood that similar equipment will be available at the receiving end for unloading each box separately.

The great advantage of the present equipment lies in the fact that it permits loading of boxes of a height coextensive with the inner height of a box-container, an acheivement which was previously possible with open-top containers only.

DETAILED DESCRIPTION OF THE DRAWINGS

Figure 1:
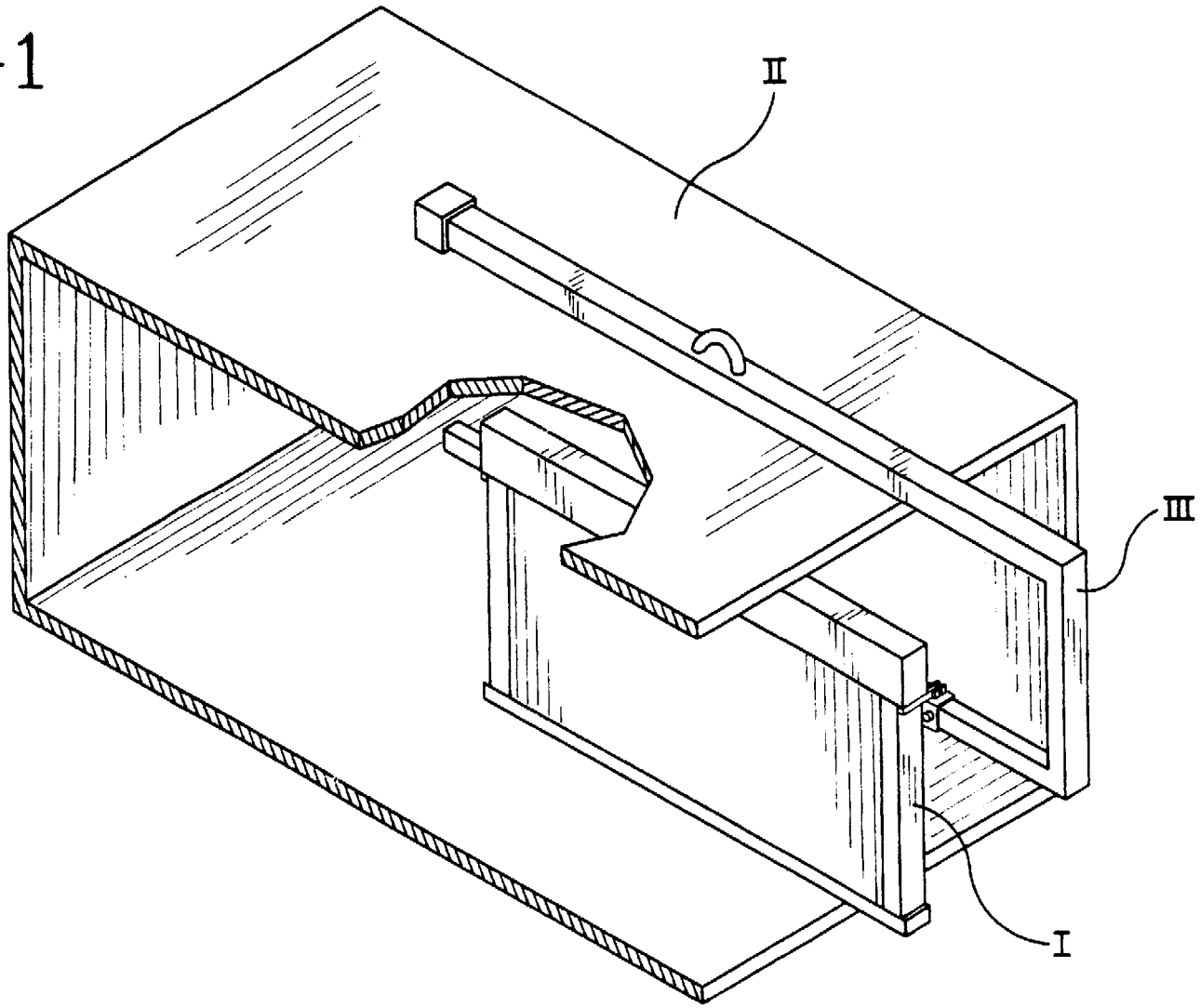
FIG. 1 is an isometric view of a box loaded into a container.

FIG. 1 shows the process of loading a box I into a box-container II by means of the loading equipment III, the container being shown with a side wall and part of the top broken open. As can be viewed, the box is being moved in by a crane—not shown—before having reached its final position on the floor in the central portion of the container.

Figure 2:
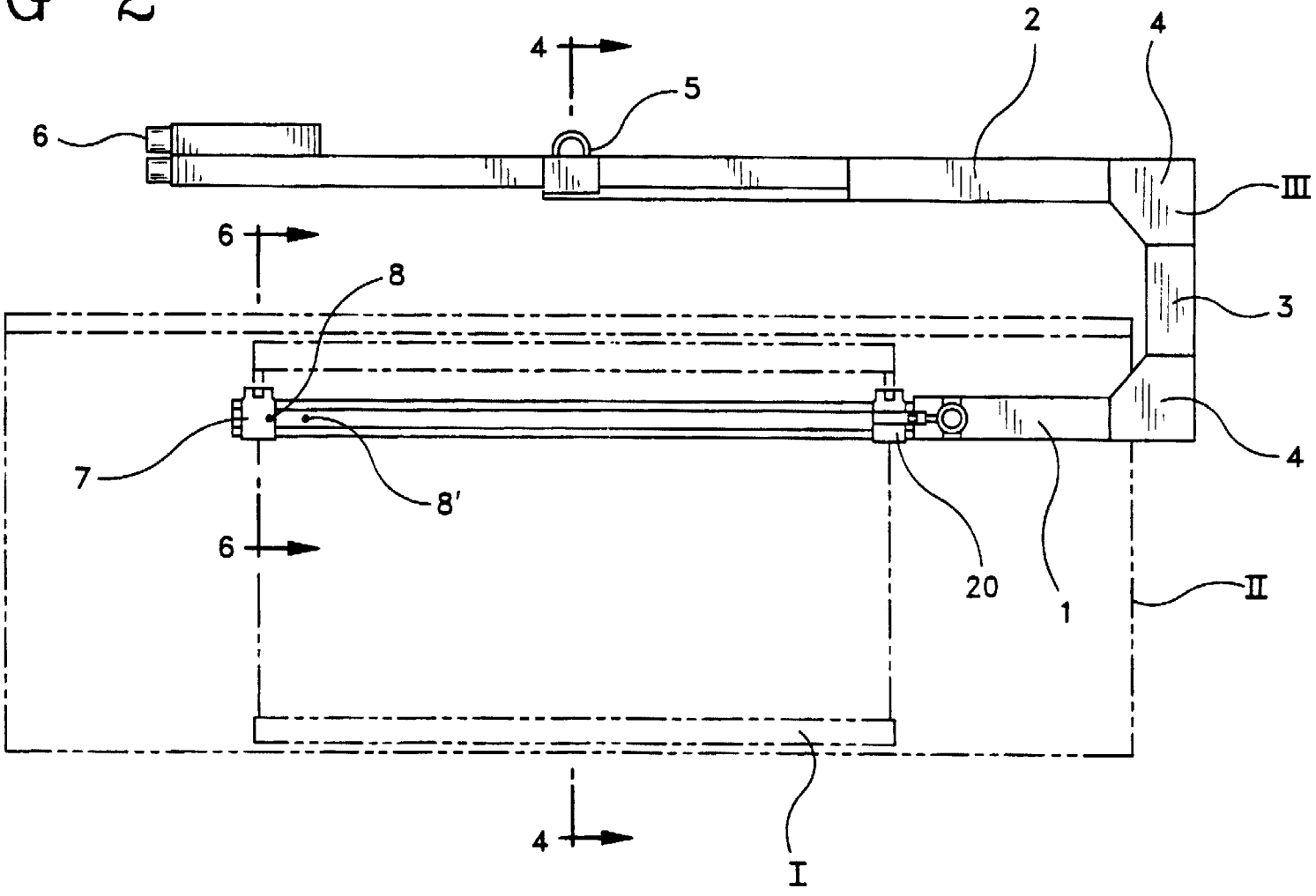
FIG. 2 is a side view of the loading equipment placing a box into a container.
Figure 3:
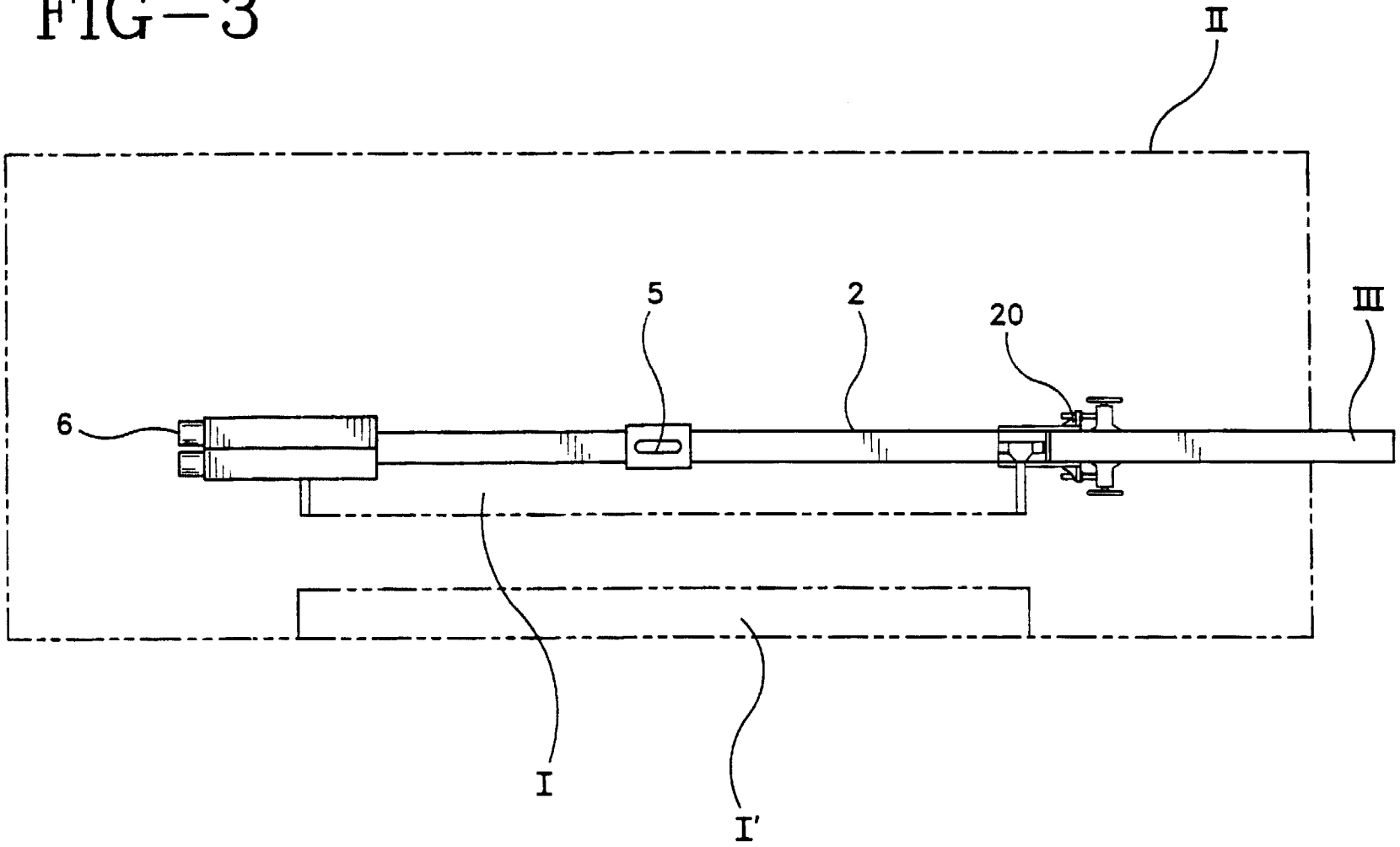
FIG. 3 is a top view of the equipment of FIG. 2.
Figure 4:
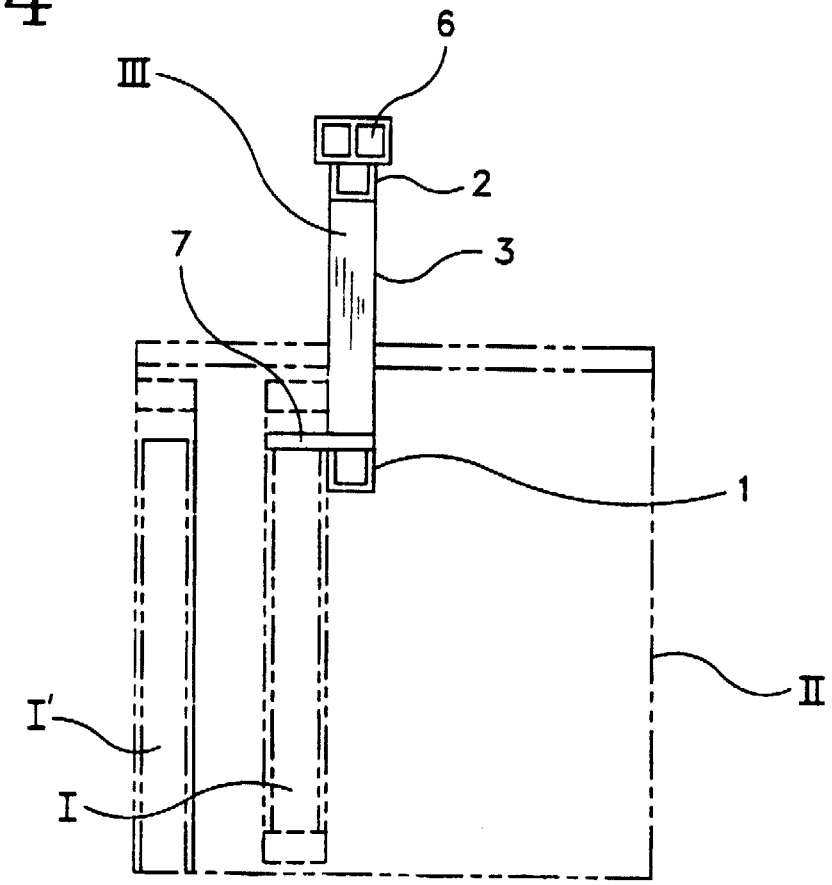
FIG. 4 is a section along line 4—4 of FIG. 2.

FIGS. 2, 3 and 4 show the loading equipment in full lines and the container II and the box I in broken lines. Also shown is a box I' which had been previously loaded and leans, sightly inclined, onto the side wall of the container. For better understanding of the description the end of the equipment first entering the container will be called the "far" end, and the end remaining outside the container will be called the "near" end. The loading equipment includes a horizontal beam 1 and a horizontal lifting arm 2 connected at their near end by a vertical branch 3 the connection being reinforced by fishplates 4. A counterweight 6 is shown to have been connected to the far end of the lifting arm with the aim to balancing the weight of the vertical branch 3, thereby effecting the horizontal alignment of the equipment.

A loop 5 is attached to the center of the lifting arm a crane hook to be inserted into the loop. It should be noted that the position of the beam on the side of the box causes it to hang from the crane hook at a slight inclination from the vertical and is placed on the container floor at the same inclination; this is a requirement serving to prevent breakage of plate or sheet glass which could shake loose and break if the sheets were standing vertically and loosely in a box.

Figure 5:
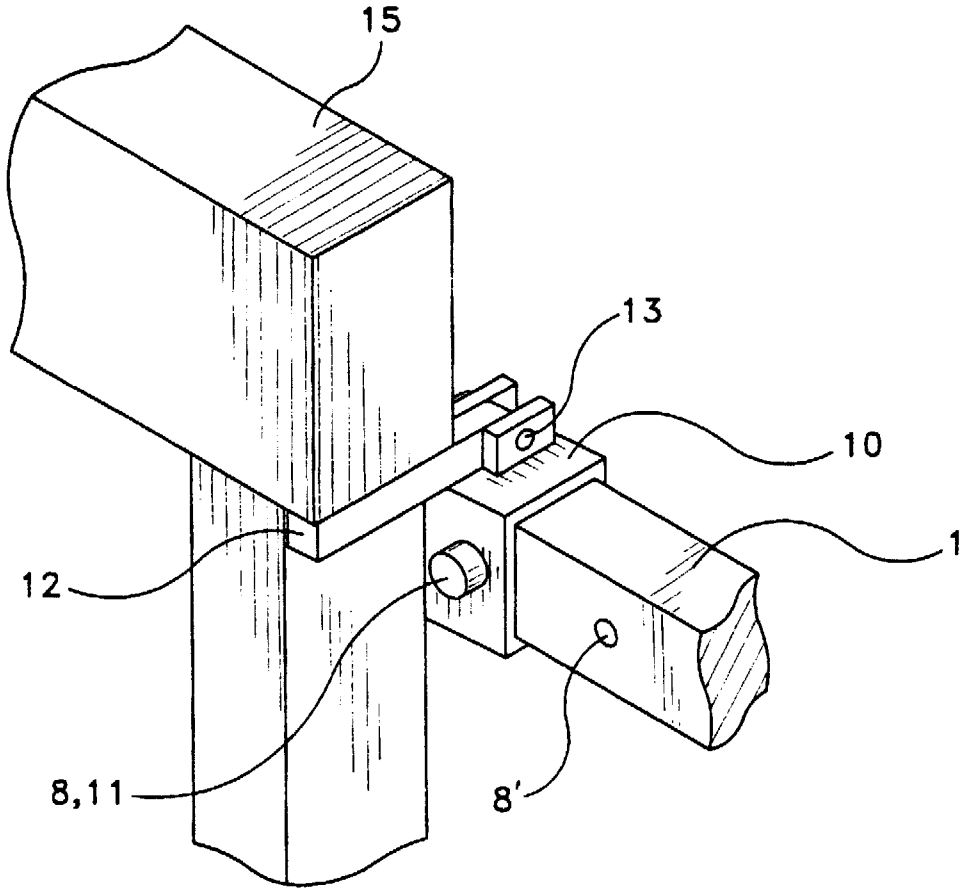
FIG. 5 is an isometric view of a gripper underneath a lug of a box.
Figure 6:
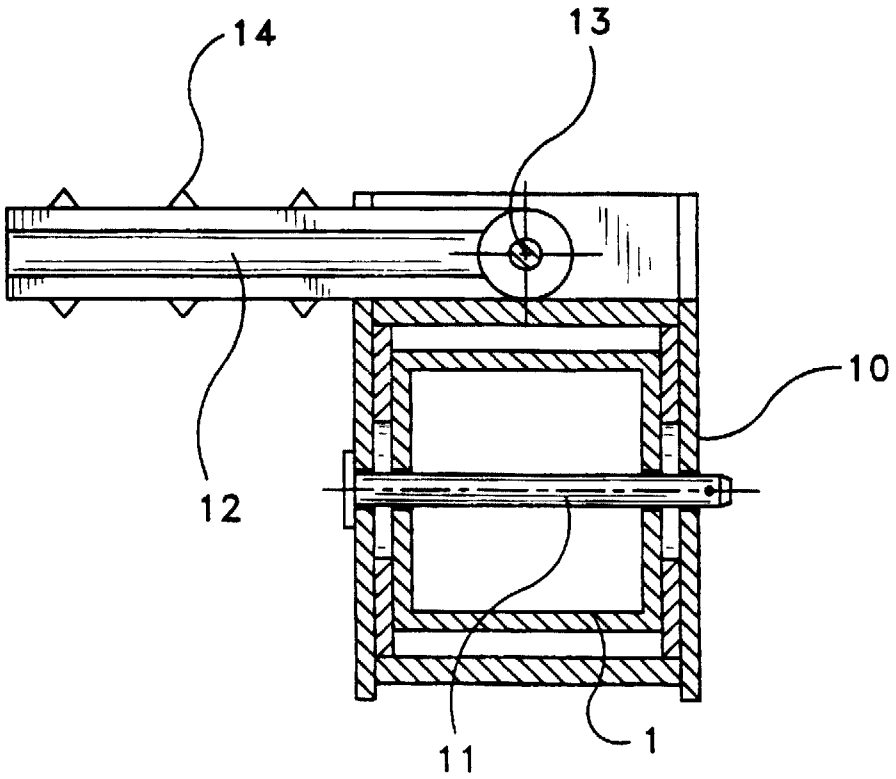
FIG. 6 is a section along line 6—6 of FIG. 2 showing the gripper at the left end of the beam.

FIG. 2 shows a gripper or gripper member 7 at the far end of the beam which is mounted on top of a sleeve 10 adapted to be moved on the beam by a distance between bores 8 and 8' in the beam. The construction of this gripper is illustrated in detail in FIGS. 5 and 6, showing the manner of changing the position of the gripper along beam 1. For this purpose the beam is perforated by at least two horizontal bores 8 and 8' serving to secure the sleeve in its position by means of a bolt 11. A short gripper bar 12 is mounted on the top surface of the sleeve by means of a pivot 13 permitting its being swung from left to right in accordance with the position of the beam on the right or the left side of the box. The sides intended to grip the underside of the lug 15 are provided with projecting sharp points 14 which are to prevent slipping of the lugs on the gripper arm.

Figure 7:
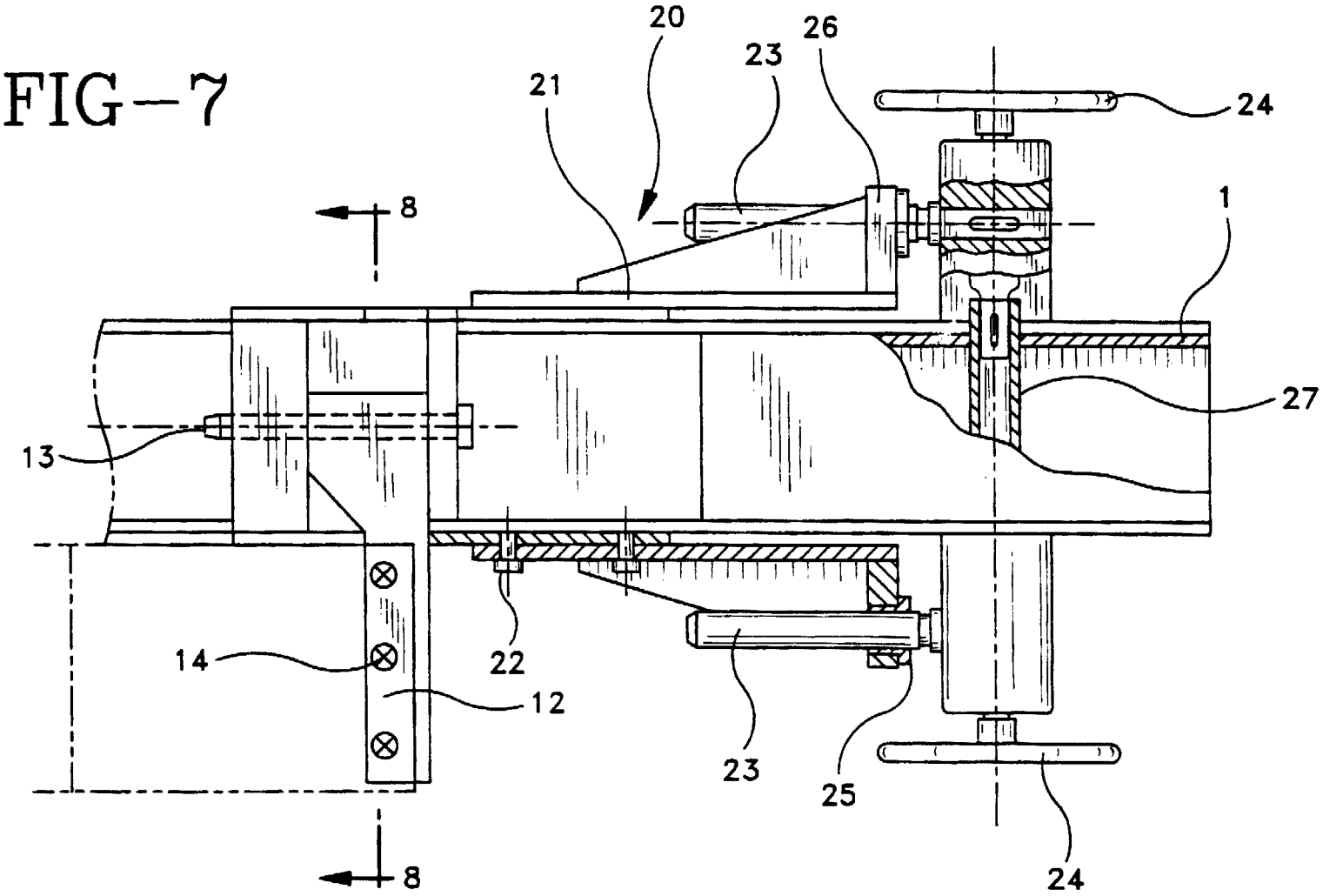
FIG. 7 is a top view and part section of the adjustable gripper mechanism on the right side of the beam shown in FIG. 2.
Figure 8:
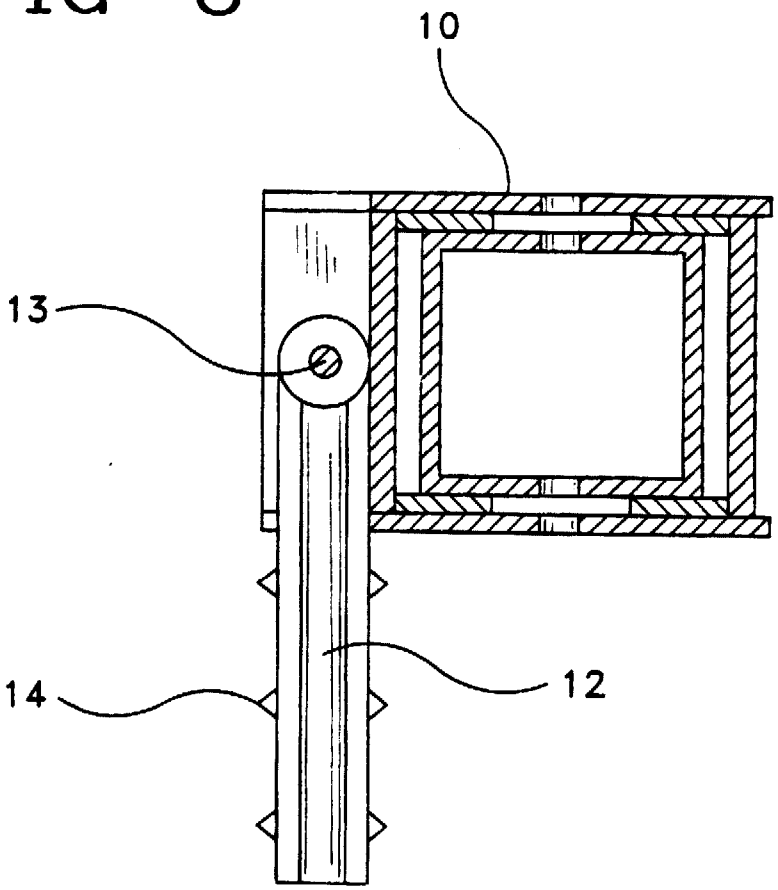
FIG. 8 is a section along line 8—8 of FIG. 7.

The gripper assembly 20 on the near side of the beam is illustrated in detail in FIGS. 7 and 8:—similar to the gripper assembly illustrated in FIG. 6 the gripper bar 12 is pivotally mounted on top of a sleeve 10' by means of a pivot 13. The sleeve 10' is of greater length than the sleeve at the far end and has its near end surrounded by an outer sleeve 21, the two sleeves being adjustably interconnected by screws 22 permitting shifting the inner sleeve 10 to be moved towards the far side relative to the outer sleeve 21. Furthermore this gripper assembly is lengthwise adjustable to correct inexact length of the box and position of the lug by a gear assembly (not visible) that rotates two screws 23 by means of handwheels 24 on both sides of the assembly. The handwheels are mounted on a common shaft 27 rotatably in the side walls of beam 1 and thus firmly fixed in longitudinal direction. The two screws engage with nuts 25 in a flange 26 which is firmly connected to the end of the outer sleeve 21. Rotation of the screws moves the outer sleeve together with the inner sleeve along the beam in order to position the gripper bar 12 underneath lug 15.

Figure 9:
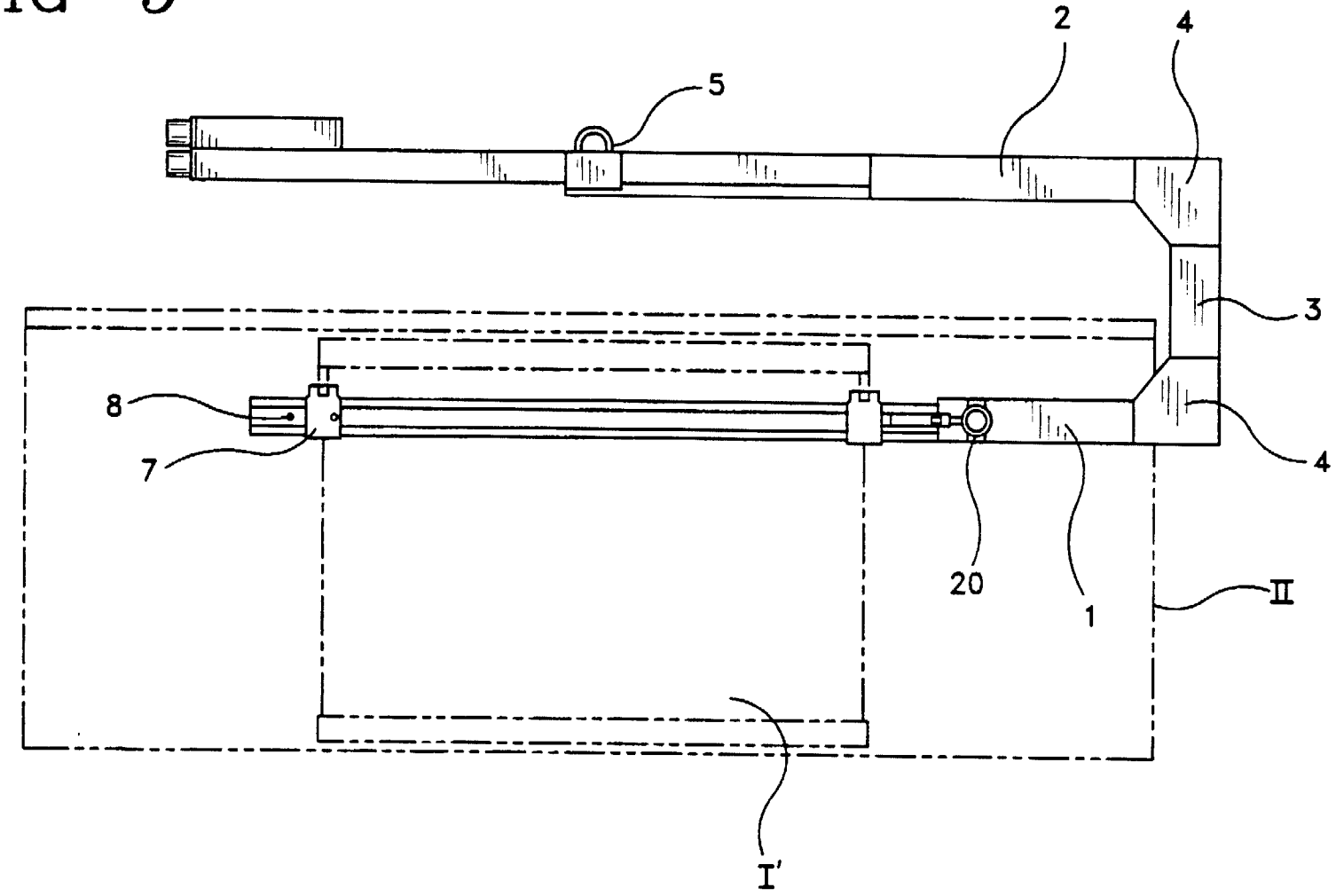
FIG. 9 is a side view of the loading equipment shown in FIG. 2, while loading a box of shorter length into a container.

FIG. 9 illustrates the equipment holding a box of shorter length with the two grippers moved towards the center line underneath the loop 5 each by an identical distance, in addition to a possible adjustment of the gripper on the near side due to inexact length of the box.

It will be understood that the gripper assembly shown in FIGS. 7 and 8 may be mounted on the far side of the beam as well, and that both gripper assemblies may be of the same kind.

Loading—and unloading—of a box into a closed-top container has been described in the Summary of the Invention. It is evident that the great advantage of the equipment of the present invention is the fact that the beam is fastened on a side of the box, thus not occupying any space on top and permitting boxes of great height to be loaded into the container. The automatic release of the grippers from the lugs avoids manual releasing of a sling from the lugs by a person standing on the far side which would require sufficient space for his emerging and preventing full loading of the container.

I claim:

1. Equipment for loading a box of relatively great length and height and of relatively narrow width into standing alignment into a closed-top box container by means of a lifting device having a hook, said box being provided with at least two lugs each projecting lengthwise from a respective end of said box, said equipment comprising:

a first portion to be inserted into said container while supporting said box, said first portion including a horizontal beam positionable in contact with a side wall of said box with no portion of said horizontal beam projecting beyond a top of said box, and two gripper members mounted on said horizontal beam in symmetrical alignment to a vertical line through said hook of said lifting device, said gripper members projecting sideways from said horizontal beam and each of said gripper members being placeable underneath a respective one of said at least two lugs of said box so as to support said box with a center of gravity of said box vertically underneath said hook of said lifting device; and a second portion remaining outside and above said container, said second portion including a lifting arm in spaced-apart alignment with said horizontal beam, a loop for attachment to said hook of said lifting device, and a branch member connecting an end of said lifting arm to an end of said horizontal beam, said branch member being configured to remain outside of said container.

2. The equipment of claim 1, wherein said lifting arm and said horizontal beam are in parallel alignment and said branch member comprises a vertical branch member connecting a near end of said lifting arm to a near end of said horizontal beam.

3. The equipment of claim 1, wherein each of said gripper members comprise a short bar of rectangular cross section having one end attached to a pivot on a top surface of a sleeve movable along said horizontal beam, said short bar of each of said gripper members being adapted to be swung about said pivot to either side of said sleeve and said horizontal beam in order to be attachable to said box on either side thereof.

4. The equipment of claim 3, wherein said movable sleeve of each of said gripper members is adapted to be secured to said horizontal beam in spaced-apart locations so that said short bar of each of said gripper members can be adjustably positioned to grip a respective one of said at least two lugs of said box at a position symmetrical with respect to a vertical line extending through said loop on said lifting arm.

5. The equipment of claim 4, wherein at least one of said movable sleeves of said gripper members is provided with a mechanism for adjustably changing a position thereof by a small distance.

6. The equipment of claim 5, wherein said at least one of movable sleeves is attached to a second sleeve at a variably fixed location, and wherein said second sleeve is adapted to be moved along said horizontal beam by two manually rotatable screws.

7. The equipment of claim 3, wherein a contact surface of said short bar of each of said gripper members is roughened to prevent slippage.

8. The equipment of claim 7, wherein said contact surface of said short bar of each of said gripper members is provided with a plurality of sharp points.

9. The equipment of claim 1, further comprising a counterweight attached to a far end of said lifting arm for balancing a weight of said box.

10. Equipment for loading boxes of great length and height and of relatively narrow width each containing a plurality of sheets of glass or another material into standing alignment into a closed-top box container by means of a crane or other lifting gear, each said box being provided with a support lug projecting out of each end of each said box, said equipment including a first portion to be inserted into said container while supporting a box and a second portion remaining outside and above said container and provided with means for attaching said equipment to a hook of said crane, wherein:

said first portion includes a horizontal beam to be positioned in contact with a side wall of said box with no portion of said beam projecting beyond a top of said box, and two gripper members mounted on said beam in symmetrical alignment to a vertical line through said hook of said crane, said gripper members projecting sideways from said beam, and each of said gripper members being placeable underneath one of said lugs so as to support said box with a center of gravity of said box vertically underneath said hook of said crane; and said second portion includes a lifting arm in spaced-apart alignment with said beam, provided with a loop for attachment of said equipment to said hook of said crane, and a branch member connecting an end of said lifting arm to an end of said beam, said branch member being configured to remain outside of said container.

11. The equipment of claim 10, wherein said lifting arm and said beam are in parallel alignment and connected at a near end by a vertical branch member.

12. The equipment of claim 10, wherein each said gripper member is in the form of a short bar of rectangular cross section having one end attached to a pivot on a top surface of a sleeve movable along said beam, said bar being adapted to be swung about said pivot to either side of said sleeve and said beam in order to permit attaching of said equipment to either side of said box.

13. The equipment of claim 12, wherein said movable sleeves are adapted to be secured to said beam in spaced-apart locations forming pairs for gripping said lugs of boxes of different standard lengths, wherein a location of each pair of gripper bars is symmetrical with respect to a vertical line extending through said loop on said lifting arm.

14. The equipment of claim 13, wherein at least one of said sleeves is provided with means for adjustably changing a position thereof by a small distance to adjust to a position of said lugs on boxes of slightly different lengths.

15. The equipment of claim 14, wherein said at least one sleeve is attached to a second sleeve at variable fixed locations, and wherein said second sleeve is adapted to be moved along said beam by two manually rotatable screws.

16. The equipment of claim 12, wherein contact surfaces of said short bars of said gripper members are roughened to prevent slipping of said lugs thereon.

17. The equipment of claim 16, wherein said contact surfaces are provided with a plurality of outstanding sharp points.

18. The equipment of claim 10, further comprising a counterweight attached to a far end of said lifting arm for balancing a weight of said box.

* * * * *